US009657737B2

(12) United States Patent
Smerud et al.

(10) Patent No.: US 9,657,737 B2
(45) Date of Patent: May 23, 2017

(54) SCROLL COMPRESSOR WITH PRESSURIZED OIL BALANCE PISTON

(71) Applicant: Trane International Inc., Piscataway, NJ (US)

(72) Inventors: Scott Joseph Smerud, La Crosse, WI (US); John Robert Sauls, La Crosse, WI (US); Michael Gerard Benco, Onalaska, WI (US); Jerry Allen Rood, Onalaska, WI (US); Keith Adam Novak, Holmen, WI (US); Derrick Lepak, La Crosse, WI (US); Joseph M. Heger, West Salem, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 358 days.

(21) Appl. No.: 14/448,382

(22) Filed: Jul. 31, 2014

(65) Prior Publication Data

US 2015/0037192 A1 Feb. 5, 2015

Related U.S. Application Data

(60) Provisional application No. 61/860,311, filed on Jul. 31, 2013.

(51) Int. Cl.

| | |
|---|---|
| ***F04C 18/04*** | (2006.01) |
| ***F04C 27/00*** | (2006.01) |
| ***F04C 18/02*** | (2006.01) |
| *F04C 23/00* | (2006.01) |

(52) U.S. Cl.

CPC ..... *F04C 27/005* (2013.01); *F04C 18/0215* (2013.01); *F04C 23/001* (2013.01); *F04C 23/008* (2013.01)

(58) Field of Classification Search

CPC ... F04C 15/0026; F04C 15/00; F04C 15/0023

USPC ..... 418/55.4

See application file for complete search history.

(56) References Cited

U.S. PATENT DOCUMENTS

| | | | |
|---|---|---|---|
| 4,600,369 | A | 7/1986 | Blain |
| 4,645,437 | A | 2/1987 | Sakashita et al. |
| 5,101,644 | A | 4/1992 | Crum et al. |
| 5,129,798 | A | 7/1992 | Crum et al. |
| 5,256,042 | A | 10/1993 | McCullough et al. |
| 5,462,419 | A | 10/1995 | Hill et al. |
| 5,616,016 | A | 4/1997 | Hill et al. |

(Continued)

*Primary Examiner* — Kenneth Bomberg
*Assistant Examiner* — Anthony Ayala Delgado
(74) *Attorney, Agent, or Firm* — Hamre, Schumann, Mueller & Larson, P.C.

(57) ABSTRACT

A scroll compressor includes an orbiting scroll member disposed within a compressor housing. The orbiting scroll member has a substantially circular baseplate and a generally spiral wrap extending from its base. A first seal is disposed proximal to the outer periphery of the orbiting scroll baseplate to provide an external seal between the baseplate and the housing. A second seal is disposed radially inward from the first seal to provide an internal seal between the baseplate and the housing. A space between the internal seal and the external seal defines a balance piston chamber. The balance piston chamber is pressurized via a high or intermediate pressure oil source to reduce thrust loading on the baseplate caused by an axial pressure differential across the baseplate.

10 Claims, 4 Drawing Sheets

(56) References Cited

U.S. PATENT DOCUMENTS

| | | | | |
|---|---|---|---|---|
| 5,720,602 | A | 2/1998 | Hill et al. | |
| 6,113,372 | A | 9/2000 | Lifson et al. | |
| 6,264,446 | B1 * | 7/2001 | Rajendran | F04C 23/008 184/6.16 |
| RE39,346 | E | 10/2006 | Lifson | |
| 7,614,860 | B2 | 11/2009 | Yano et al. | |
| 2010/0322809 | A1 * | 12/2010 | Masuda | F04C 18/045 418/55.6 |
| 2011/0211983 | A1 | 9/2011 | Bush | |
| 2012/0128518 | A1 | 5/2012 | Yamada et al. | |

* cited by examiner

SCROLL COMPRESSOR WITH PRESSURIZED OIL BALANCE PISTON

FIELD

The embodiments described herein relate generally to scroll compressors. More particularly, the embodiments described herein relate to a balance piston structure that provides an axial force opposing a net thrust force caused by an axial pressure differential across the base plate of a scroll compressor orbiting scroll.

BACKGROUND

One increasingly popular type of compressor is a scroll compressor. In a scroll compressor, a pair of scroll members orbits relative to each other to compress an entrapped refrigerant.

In typical scroll compressors, a first, stationary, scroll member has a base and a generally spiral wrap extending from its base. A second, orbiting, scroll member has a base and a generally spiral wrap extending from its base. The second, orbiting, scroll member is driven to orbit by a rotating shaft. Some scroll compressors employ an eccentric pin on the rotating shaft that drives the second, orbiting, scroll member.

SUMMARY

In a two-stage scroll compressor, one of the orbiting scrolls may operate with an axial pressure differential across the base plate resulting in increased or decreased net axial thrust loading. Assuming that orbiting scroll stability concerns dictate that the force due to this pressure differential is added to the thrust load, this pressure differential may cause excessive thrust loads having negative effects on compressor performance and reliability.

In view of the foregoing, there is a need to provide a scheme that provides an axial force opposing a net thrust force caused by an axial pressure differential across the base plate of a scroll compressor orbiting scroll.

According to one embodiment, a scroll compressor comprises an orbiting scroll member disposed within a compressor housing. The orbiting scroll member has a substantially circular baseplate and a generally spiral wrap extending from its baseplate. A first seal is disposed proximal to the outer periphery of the orbiting scroll baseplate to provide an external seal between the baseplate and the housing. A second seal is disposed radially inward from the first seal to provide an internal seal between the baseplate and the housing. A space between the internal seal and the external seal defines a balance piston chamber. The balance piston chamber is pressurized via a high or intermediate pressure oil source to reduce thrust loading on the baseplate caused by an axial pressure differential across the orbiting scroll baseplate.

DRAWINGS

These and other features, aspects, and advantages of the balance piston structure and methods and systems including the balance piston structure will become better understood when the following detailed description is read with reference to the accompanying drawing, wherein.

While the above-identified drawing figures set forth particular embodiments of the balance piston structure and methods and systems including the balance piston structure, other embodiments are also contemplated, as noted in the discussion. In all cases, this disclosure presents illustrated embodiments by way of representation and not limitation. Numerous other modifications and embodiments can be devised by those skilled in the art which fall within the scope and spirit of the principles of the balance piston structure and methods and systems including the balance piston structure described herein.

DETAILED DESCRIPTION

Figure 1:
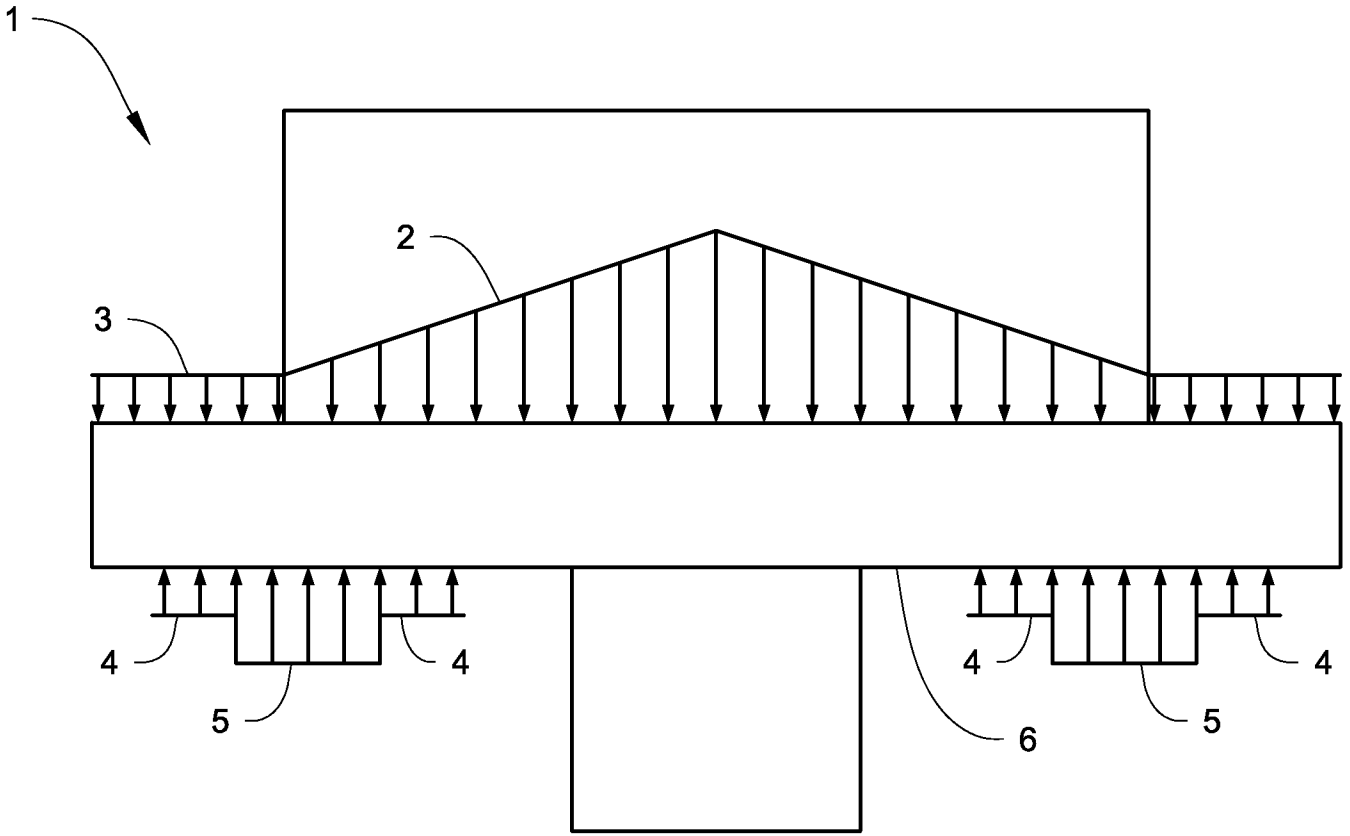
FIG. 1 is a simplified side view of an orbiting scroll illustrating axial gas forces, axial pressure differential forces, thrust bearing forces and balance piston forces across the orbiting scroll baseplate, according to one embodiment.

FIG. 1 is a simplified side view of an orbiting scroll 1 illustrating axial gas forces due to compression (Fag), axial pressure differential forces (Fdp) 3, thrust bearing forces (Ftb) 4 and balance piston forces (Fbp) 5 across the orbiting scroll baseplate 6, according to one embodiment. In a practical two-stage scroll compressor, one of the orbiting scrolls may operate with an axial pressure differential (Fdp) across the base plate resulting in increased or decreased net axial thrust loading (Ftb), as stated herein. An oil pressurized chamber (balance piston) resulting in an axial force (Fbp) opposing the net thrust force (Fag+Fdp) 2, caused by this pressure differential (Fdp) can be used to reduce thrust loading and can result in higher performance and improved thrust surface reliability, as also stated herein.

Figure 2:
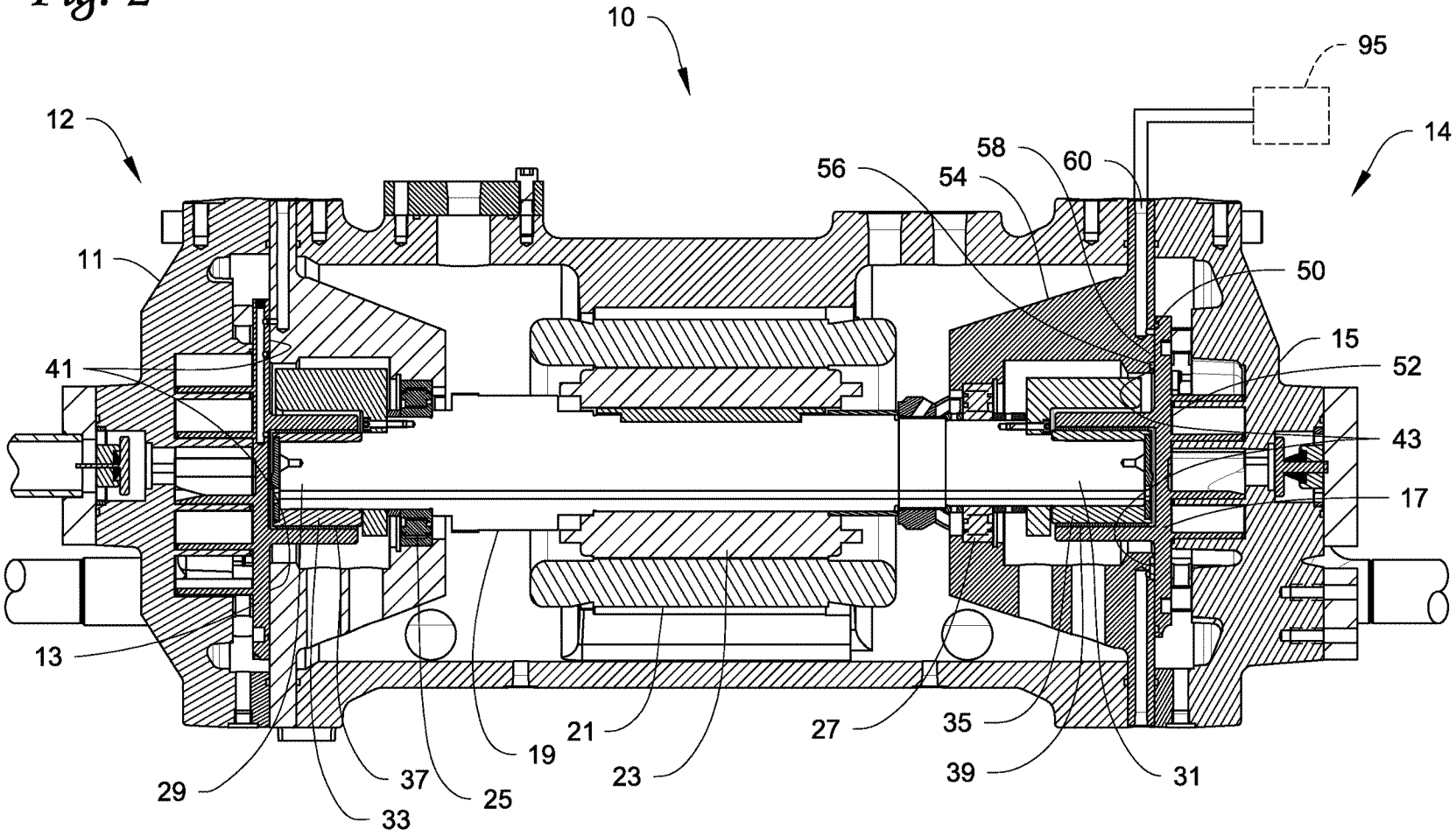
FIG. 2 is a cross-sectional view illustrating a horizontal two-stage scroll compressor that employs a balance piston, according to one embodiment.

FIG. 2 illustrates a two-stage horizontal scroll compressor 10 comprising a balance piston structure, according to one embodiment.

Although particular embodiments are described herein with respect to horizontal two-stage scroll compressors, it will be appreciated the principles described herein are not so limited, and may just as easily be applied to multi-stage scroll compressors having more than two stages as well as single-stage scroll compressors. It will be appreciated that, while horizontal orientation of a scroll compressors are discussed and shown, the Oldham coupling features described herein can apply to and be suitable for vertically oriented scroll compressors.

The two-stage horizontal scroll compressor 10 is illustrated in cross-sectional side view. Scroll compressor 10 comprises a first, input stage 12 and a second, output stage 14. The first, input stage 12 comprises a fixed, non-orbiting scroll member 11 and an orbiting scroll member 13. The non-orbiting scroll member 11 is positioned in meshing engagement with the orbiting scroll member 13.

The second, output stage 14 also comprises a fixed, non-orbiting scroll member 15 and an orbiting scroll member 17. The second stage non-orbiting scroll member 15 is positioned in meshing engagement with the second stage orbiting scroll member 17.

Scroll compressor 10 further comprises a compressor drive shaft 19 or crankshaft extending between the first, input stage 12 and the second, output stage 14. The crankshaft 19 may be rotatably driven, by way of example and not limitation, via an electric motor comprising a wound stator 21 and a rotor 23 which may or may not be in an interference-fit on the compressor crankshaft 19. The crankshaft 19 may be rotatably journaled within one or more main bearings 25, 27. Each crankshaft main bearing 25, 27 may comprise, by way of example and not limitation, a rolling element bearing having a generally cylindrical portion.

The compressor crankshaft 19 further may comprise a first eccentric drive pin 29 disposed at its first, input stage end. The compressor crankshaft may further comprise a second eccentric drive pin 31 disposed at its second, output stage end. Each eccentric drive pin may be disposed within a bearing sleeve 33, 35 that is placed over a respective eccentric drive pin. The scroll compressor 10 may then operate to provide an orbiting motion of each set of intermeshing scrolls via an orbital radial bearing 37, 39 that is placed over its respective bearing sleeve 33, 35.

According to one embodiment, the first stage 12 further comprises a conventional hydrodynamic type orbiting scroll thrust bearing 41; while the second stage of compression 14 further comprises a hydrostatic type orbiting scroll thrust bearing 43.

It will be appreciated that the specific bearing types described above are examples only and meant to be non-limiting, as other bearing types may be employed in any of the rolling element, radial, and/or thrust bearings mentioned above.

In a practical two-stage scroll compressor, one of the orbiting scrolls may operate with an axial pressure differential across the base plate resulting in increased or decreased net axial thrust loading, as stated herein. Assuming that orbiting scroll stability concerns dictate that the force due to this pressure differential is added to the thrust load, this pressure differential could cause excessive thrust loads that may have undesirable and/or negative effects on compressor performance and reliability, as also stated herein.

An oil pressure chamber (balance piston) resulting in an axial force opposing the net thrust force caused by this pressure differential can be used to reduce thrust load and can result in higher performance and improved thrust surface reliability. This balance piston may be fed by an external discharge or intermediate pressure oil separator or by means of any internal or external source of high pressure oil.

Regulating the pressure supplied to the balance piston allows other concerns, such as, without limitation, scroll stability, to be addressed; while the net operational thrust force can be minimized or at least reduced to the extent allowed by the high pressure oil source.

Keeping the foregoing principles in mind, and with continued reference to FIG. 2, an oil pressurized balance piston in one embodiment comprises a first seal 50 disposed proximal to the outer periphery of the second stage orbiting scroll baseplate 52 to provide an external seal between the baseplate 52 and the compressor housing bearing 54. A second seal 56 is disposed radially inward from the first seal 50 to provide an internal seal between the second stage orbiting scroll baseplate 52 and the compressor housing 54. A space between the internal seal 56 and the external seal 50 defines an oil pressurized balance piston chamber 58. The balance piston chamber 58 is pressurized via a high or intermediate pressure oil source, based on the particular application, to reduce thrust loading on the baseplate 52 caused by an axial pressure differential across the baseplate 52, as described herein for example with reference to FIG. 1.

It will be appreciated that one or both the internal and external seals 50, 56 may be affixed to the compressor bearing housing 54. According to one embodiment, the oil pressurized balance piston chamber area is maximized by affixing the external seal 50 to the second stage orbiting scroll baseplate 52 and affixing the internal seal 56 to the compressor bearing housing 54, such as illustrated in FIG. 2.

An oil injection port 60 receives oil from an external discharge or intermediate pressure oil separator, or any internal or external source of high pressure oil, such as stated herein, to provide an axial force opposing the net thrust forces on the orbiting scroll baseplate 52 described with reference to FIG. 1.

Figure 3:
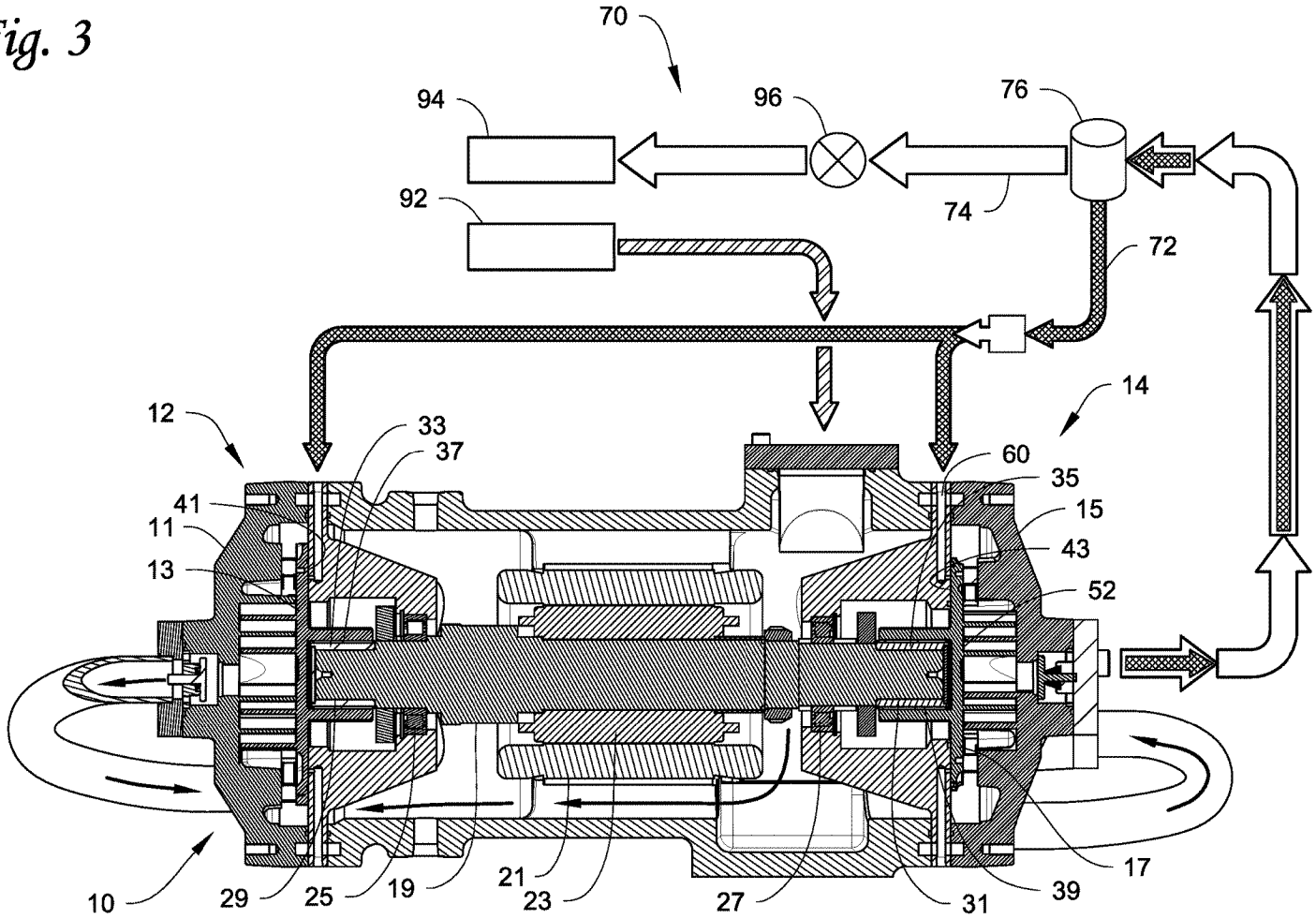
FIG. 3 illustrates application of a high side oil separator that is suitable for use to pressurize the balance piston depicted in FIG. 2, according to one embodiment.

FIG. 3 illustrates one embodiment of a high side oil separation system 70 that may supply the oil injection port 60 with pressurized oil sufficient to provide an axial force suitable for opposing the net thrust forces caused by a pressure differential across the second stage orbiting scroll baseplate 52.

The two-stage horizontal scroll compressor 10 is illustrated in cross-sectional side view. Scroll compressor 10 comprises a first, input stage 12 and a second, output stage 14. The first, input stage 12 comprises a fixed, non-orbiting scroll member 11 and an orbiting scroll member 13. The non-orbiting scroll member 11 is positioned in meshing engagement with the orbiting scroll member 13.

The second, output stage 14 also comprises a fixed, non-orbiting scroll member 15 and an orbiting scroll member 17. The second stage non-orbiting scroll member 15 is positioned in meshing engagement with the second stage orbiting scroll member 17.

Scroll compressor 10 further comprises a compressor drive shaft 19 or crankshaft extending between the first, input stage 12 and the second, output stage 14. The crankshaft 19 may be rotatably driven, by way of example and not limitation, via an electric motor comprising a wound stator 21 and a rotor 23 which may or not be interference-fit on the compressor crankshaft 19. The crankshaft 19 may be rotatably journaled within one or more main bearings 25, 27. Each crankshaft main bearing 25, 27 may comprise, by way of example and not limitation, a rolling element bearing having a generally cylindrical portion.

The compressor crankshaft 19 further may comprise a first eccentric drive pin 29 disposed at its first, input stage end. The compressor crankshaft may further comprise a second eccentric drive pin 31 disposed at its second, output stage end. Each eccentric drive pin may be disposed within a bearing sleeve 33, 35 that is placed over a respective eccentric drive pin. The scroll compressor 10 may then operate to provide an orbiting motion of each set of intermeshing scrolls via an orbital radial bearing 37, 39 that is placed over its respective bearing sleeve 33, 35.

According to one embodiment, the first, input stage of compression 12 further comprises a conventional hydrodynamic type orbiting scroll thrust bearing 41; while the second, output stage of compression 14 further comprises a hydrostatic type orbiting scroll thrust bearing 43.

It will be appreciated that the specific bearing types described above are examples only and meant to be non-limiting, as other bearing types may be employed in any of the rolling element, radial, and/or thrust bearings mentioned above.

It can be appreciated that controlling the amount of oil that flows from a compressor into a condenser can generally be implemented in two ways. First, the amount of oil that enters the compression pockets and that is carried by the refrigerant into the condenser can be limited. Second, oil can be separated from the refrigerant after the compression process and subsequently returned to the compressor.

With continued reference to FIG. 3, the high side pressure oil separation system 70 for the two-stage horizontal scroll compressor 10 further illustrates separation of oil 72 from a refrigerant 74 at a second stage 14 discharge pressure via a high side oil separator 76 following the compression process, and then returning the separated oil 72 to the compressor oil injection port 60 (shown in detail in FIG. 2) from which the oil pressurized chamber (balance piston), enumerated 58 in FIG. 2, receives a requisite or suitable amount of pressurized oil. For purposes of illustration, an evaporator 92, a condenser 94, and a backpressure valve 96 are also schematically shown.

According to another embodiment, oil could just as easily be supplied to the compressor oil injection port 60 at an intermediate pressure to pressurize the balance piston chamber and reduce thrust loading on the orbiting scroll baseplate 52 caused by an axial pressure differential across the baseplate 52 for a particular application requiring less oil pressure in the balance piston chamber. An exemplary embodiment is illustrated in FIG. 4 that illustrates application of an intermediate pressure oil separator that is suitable for use to pressurize the balance piston.

Figure 4:
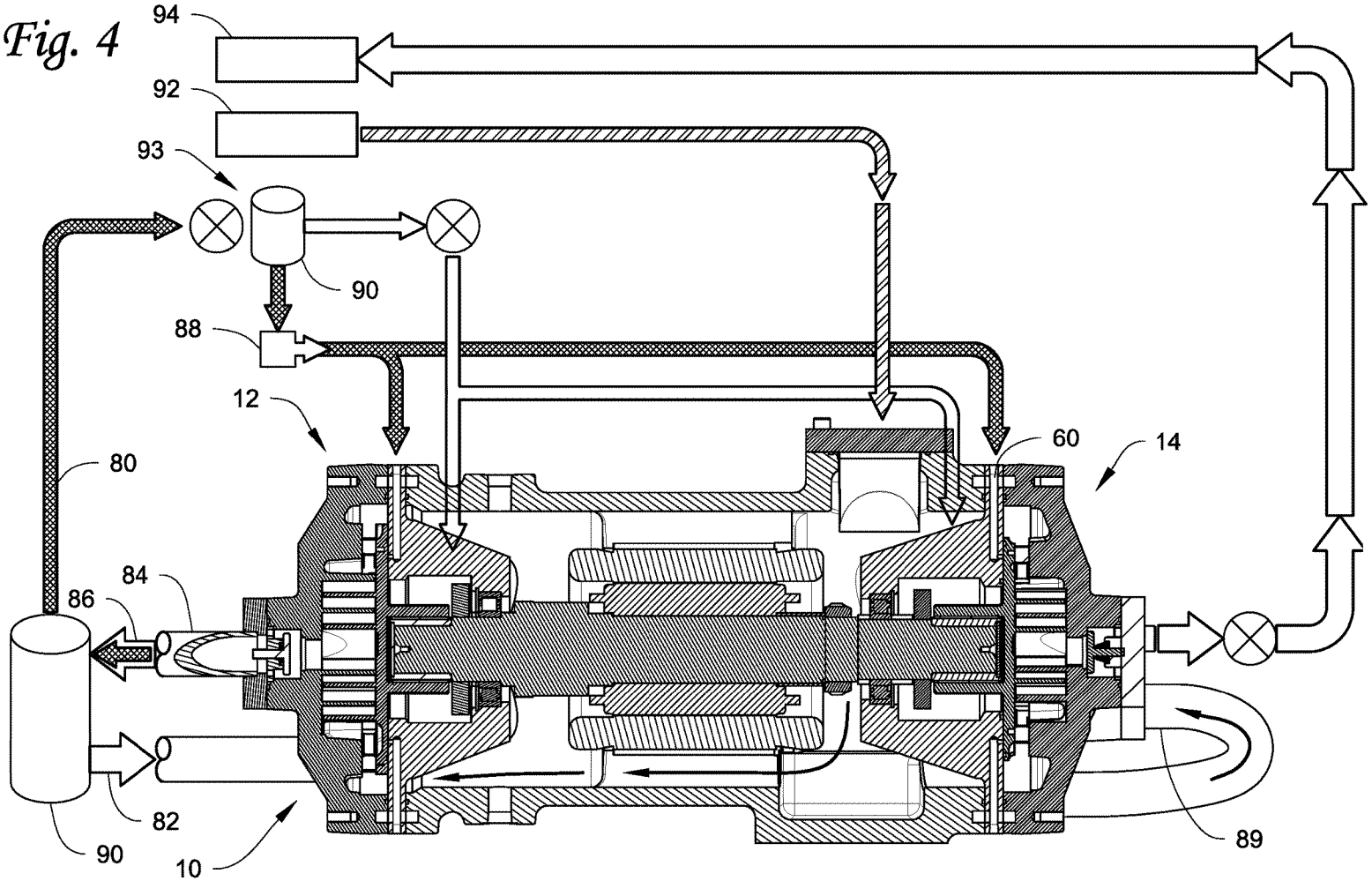
FIG. 4 illustrates application of an intermediate pressure oil separator that is suitable for use to pressurize the balance piston depicted in FIG. 2, according to one embodiment.

Looking now at FIG. 4, and keeping the foregoing principles in mind, separation of oil 80 from a refrigerant 82 is performed at intermediate pressure following the first stage of compression 12. The separated oil 80 is then routed back to the compressor oil injection port 60 (shown in detail in FIG. 2) at an intermediate pressure.

More specifically, in the two stage horizontal scroll compressor 10, refrigerant 82 flows from the first stage of compression 12 to the second stage of compression 14 via an interconnecting refrigerant line 84. Oil from the bearings which are in the first stage suction cavity of the two stage compressor 10 may be entrained in the refrigerant stream that is entering the first stage of compression 12 and may be carried with the refrigerant out of the first stage of compression 12 and through the interconnecting refrigerant line toward the second stage of compression 14.

An oil separator 90 that may be functionally and fluidly connected in series with the interconnecting refrigerant line 84 can remove oil from the refrigerant stream 86. The oil 80, which is pressurized at an intermediate pressure when exiting the first stage of compression 12, may then be routed to the suction stage bearings in the first and second stages of compression 12, 14, as well as the compressor oil injection port 60 at an intermediate pressure to pressurize the balance piston chamber, enumerated 58 in FIG. 2; and the cycle may then repeat itself.

In order to avoid the possibility of foreign particles being continuously circulated to the bearings and/or the compressor oil injection port 60, in some embodiments a filter 88 may also be provided. The oil filter 88 may be formed, by way of example and not limitation, from a relatively fine mesh stainless steel screen material. Foreign particles can be separated from the oil as it flows downwardly therethrough, so that they are not circulated to the bearing surfaces. It should also be noted that filter 88 may have a substantial surface area and hence can be suitably constructed and/or arranged so as to not restrict oil flow to the suction stage bearings even with an accumulation of foreign particles thereon. In addition to separating foreign particles from the lubricating oil, the filter 88 may also under some circumstances aid in inhibiting gaseous refrigerant from being drawn into the suction stage bearings 25, 37, e.g. by way of compressor oil injection port 60.

The refrigerant 82 continues through the interconnecting refrigerant line 84 to the second stage suction port 89. Since the oil separator 90 after the first stage of compression 12 may act as an oil reservoir at intermediate pressure, oil can advantageously flow from the oil separator 90 to the compressor oil injection port 60 at an intermediate pressure to pressurize the balance piston chamber, and so the use of a pump can be avoided.

According to another embodiment, the capacity of the compressor 10 for some operating conditions may optionally be reduced by routing flow 86 out of the first stage of compression 12 through an evaporator 92 and back to the compressor oil injection port 60 at an intermediate pressure to pressurize the balance piston chamber, herein referred to as first stage bypass. First stage bypass is activated when using, for example location 93 for the oil separator 90 to first separate oil from the refrigerant flow before the refrigerant is bypassed through the evaporator 92. For illustrations purposes, a condenser 94 is schematically shown.

Looking again at FIG. 2, the balance piston chamber 58 may instead be pressurized from an external high pressure oil sump 95. Such an external high pressure oil sump may be used to reduce thrust loading on the orbiting scroll baseplate 52 caused by an axial pressure differential across the baseplate 52 for a particular application requiring a higher oil pressure in the balance piston chamber.

In summary explanation, one embodiment of a scroll compressor 10 has been described having an oil pressurized balance piston to offset excessive thrust loads which may be partially caused by an axial pressure differential. The scroll compressor 10 includes an orbiting scroll member 17 disposed within a compressor bearing housing 54. The orbiting scroll member 17 has a substantially circular baseplate 52 and a generally spiral wrap extending from its baseplate 52. A first seal 50 is disposed proximal to the outer periphery of the orbiting scroll baseplate 52 to provide an external seal between the baseplate 52 and the housing 54. A second seal 56 is disposed radially inward from the first seal 50 to provide an internal seal between the baseplate 52 and the housing 54. A space between the internal seal 56 and the external seal 50 defines a balance piston chamber 58. The balance piston chamber 58 is pressurized via a pressure oil source 76 to reduce thrust loading on the orbiting scroll baseplate 52 caused by an axial pressure differential across the orbiting scroll baseplate 52.

Although balance pistons have been employed in scroll compressors to force the tips of orbiting scrolls together, such structures have not employed independent seals 50, 56 such as described herein to implement an oil pressure chamber (balance piston) resulting in an axial force opposing the net thrust force caused by a pressure differential across an orbiting scroll baseplate to reduce thrust loading and provide higher performance and improved thrust surface reliability. Further, earlier attempts at balancing operational axial forces on an orbiting scroll have been by means of using intermediate or discharge pressure gas in a closed chamber contained with dynamic seals. The embodiments described herein instead can advantageously use intermediate or discharge pressurized oil to improve sealing and provide sufficient lubrication of seals at all operating conditions.

Any of aspects 1 to 10 can be combined with any of aspects 11 to 21.

Aspect 1. A scroll compressor, comprising: a compressor housing; an output stage of compression disposed within the compressor housing, the output stage comprising: a first, stationary, scroll member comprising a base and a generally spiral wrap extending from the base of the first, stationary, scroll member; and a second, orbiting, scroll member comprising a substantially circular base and a substantially spiral wrap extending from the base of the second, orbiting scroll member; a first seal disposed proximal to the outer periphery of the substantially circular base and forming an external seal between the substantially circular base and the compressor housing; a second seal disposed radially inward from the first seal and forming an internal seal between the substantially circular base and the compressor housing, wherein a space between the internal seal and the external seal defines a balance piston chamber; and an oil passage disposed within the compressor housing and configured to receive pressurized oil from an oil source and to deliver the received pressurized oil to the balance piston chamber, such that thrust loading on the substantially circular base caused by an axial pressure differential across the substantially circular base is reduced in response to the received pressurized oil in the balance piston chamber.

Aspect 2. The scroll compressor according to aspect 1, wherein the scroll compressor is a single-stage scroll compressor.

Aspect 3. The scroll compressor according to aspect 1 or 2, wherein the scroll compressor is a two-stage scroll compressor.

Aspect 4. The scroll compressor according to any of aspects 1 to 3, wherein the scroll compressor comprises more than two stages of compression.

Aspect 5. The scroll compressor according to any of aspects 1 to 4, wherein the scroll compressor is a horizontal scroll compressor.

Aspect 6. The scroll compressor according to any one of aspects 1 to 5, wherein the oil passage is further configured to receive pressurized oil at the output stage discharge pressure from an external high side oil separator.

Aspect 7. The scroll compressor according to any of aspects 1 to 6, wherein the oil passage is further configured to receive pressurized oil at an intermediate discharge pressure less than the output stage discharge pressure.

Aspect 8. The scroll compressor according to any of aspects 1 to 7, wherein the oil passage is further configured to receive pressurized oil from an external pressure source.

Aspect 9. The scroll compressor according to any of aspects 1 to 8, wherein the oil passage is further configured to receive pressurized oil from an internal pressure source.

Aspect 10. The scroll compressor according to any of aspects 1 to 9, further comprising an orbiting scroll hydrostatic thrust bearing configured to limit thrust loading on the substantially circular base of the second, orbiting, scroll member.

Aspect 11. A scroll compressor, comprising: an output stage of compression disposed within a compressor housing, the output stage comprising: a stationary scroll member comprising a base and a generally spiral wrap extending from the base of the stationary scroll member; and an orbiting, scroll member comprising a substantially circular base and a substantially spiral wrap extending from the base of the orbiting scroll member; a first seal affixed to the substantially circular base and forming an external seal between the substantially circular base and the compressor housing proximal the outer periphery of the substantially circular base; and a second seal affixed to the compressor housing and disposed radially inward from the first seal to form an internal seal between the substantially circular base and the compressor housing, wherein a space between the internal seal and the external seal defines a balance piston chamber.

Aspect 12. The scroll compressor according to aspect 11, wherein the compressor housing comprises a passageway disposed therein and configured to receive pressurized oil from a source of pressurized oil and to deliver the received pressurized oil to the balance piston chamber, such that thrust loading on the substantially circular base caused by an axial pressure differential across the substantially circular base is reduced in response to the received pressurized oil in the balance piston chamber.

Aspect 13. The scroll compressor according to aspect 12, wherein the passageway is further configured to receive pressurized oil at the output stage discharge pressure from an external high side oil separator.

Aspect 14. The scroll compressor according to aspect 12 or 13, wherein the passageway is further configured to receive pressurized oil at an intermediate discharge pressure less than the output stage discharge pressure from an external intermediate pressure oil separator.

Aspect 15. The scroll compressor according to any of aspects 12 to 14, wherein the passageway is further configured to receive pressurized oil from an external oil sump.

Aspect 16. The scroll compressor according to any of aspects 12 to 15, wherein the passageway is further configured to receive pressurized oil from an internal pressure source.

Aspect 17. The scroll compressor according to any of aspects 11 to 16, wherein the scroll compressor is a single-stage scroll compressor.

Aspect 18. The scroll compressor according to any of aspects 11 to 17, wherein the scroll compressor is a two-stage scroll compressor.

Aspect 19. The scroll compressor according to any of aspects 11 to 18, wherein the scroll compressor comprises more than two stages of compression.

Aspect 20. The scroll compressor according to any of aspects 11 to 19, wherein the scroll compressor is a horizontal scroll compressor.

Aspect 21. The scroll compressor according to any of aspects 11 to 20, further comprising an orbiting scroll hydrostatic thrust bearing configured to limit thrust loading on the substantially circular base of the orbiting scroll member.

While the embodiments have been described in terms of various specific embodiments, those skilled in the art will recognize that the embodiments can be practiced with modification within the spirit and scope of the claims.

What is claimed is:

1. A scroll compressor, comprising:

a compressor housing;

an output stage of compression disposed within the compressor housing having an output discharge pressure, the output stage comprising:

a first, stationary, scroll member comprising a base and a substantially spiral wrap extending from the base of the first, stationary, scroll member; and a second, orbiting, scroll member comprising a substantially circular base and a substantially spiral wrap extending from the base of the second, orbiting scroll member;

a first seal disposed proximal to the outer periphery of the substantially circular base and forming an external seal between the substantially circular base and the compressor housing;

a second seal disposed radially inward from the first seal and forming an internal seal between the substantially circular base and the compressor housing, wherein a space between the internal seal and the external seal defines a balance piston chamber; and an oil passage disposed within the compressor housing and configured to receive pressurized oil from one of:

an external oil separator at the output stage discharge pressure; and an oil source at an intermediate discharge pressure less than the output stage discharge pressure, and the oil passage configured to deliver the received pressurized oil to the balance piston chamber, such that thrust loading on the substantially circular base caused by an axial pressure differential across the substantially circular base is reduced in response to the received pressurized oil in the balance piston chamber.

2. The scroll compressor according to claim 1, wherein the scroll compressor is one of a single-stage scroll compressor, a two-stage scroll compressor, and a scroll compressor that comprises more than two stages of compression.

3. The scroll compressor according to claim 1, wherein the scroll compressor is a horizontal scroll compressor.

4. A scroll compressor, comprising:

an output stage of compression disposed within a compressor housing, the output stage comprising:

a stationary scroll member comprising a base and a substantially spiral shaped wrap extending from the base of the stationary scroll member; and an orbiting, scroll member comprising a substantially circular base and a substantially spiral wrap extending from the base of the orbiting scroll member;

a first seal affixed to the substantially circular base and forming an external seal between the substantially circular base and the compressor housing proximal the outer periphery of the substantially circular base; and a second seal affixed to the compressor housing and disposed radially inward from the first seal to form an internal seal between the substantially circular base and the compressor housing, wherein a space between the internal seal and the external seal defines a balance piston chamber; wherein, the compressor housing comprises a passageway disposed therein and configured to receive pressurized oil from an external oil source and to deliver the received pressurized oil to the balance piston chamber, such that thrust loading on the substantially circular base caused by an axial pressure differential across the substantially circular base is reduced in response to the received pressurized oil in the balance piston chamber.

5. The scroll compressor according to claim 4, wherein the passageway is further configured to receive pressurized oil at the output stage discharge pressure from an external high side oil separator.

6. The scroll compressor according to claim 4, wherein the passageway is further configured to receive pressurized oil at an intermediate discharge pressure less than the output stage discharge pressure from an external intermediate pressure oil separator.

7. The scroll compressor according to claim 4, wherein the passageway is further configured to receive pressurized oil from an external oil sump.

8. The scroll compressor according to claim 4, wherein the scroll compressor is one of a single-stage scroll compressor, a two-stage scroll compressor, and a scroll compressor that comprises more than two stages of compression.

9. The scroll compressor according to claim 4, wherein the scroll compressor is a horizontal scroll compressor.

10. The scroll compressor according to claim 4, wherein the passageway is further configured to receive pressurized oil from an external evaporator.

* * * * *